United States Patent [19]

Fastenrath et al.

[11] 4,404,535

[45] Sep. 13, 1983

[54] PUSH BUTTON POWER SWITCH

[75] Inventors: Ulrich Fastenrath, Kierspe; Siegfried Schulte, Lüdenscheid, both of Fed. Rep. of Germany

[73] Assignee: Schulte-Elektrotechnik GmbH & Co., KG, Lüdenscheid, Fed. Rep. of Germany

[21] Appl. No.: 339,041

[22] Filed: Jan. 13, 1982

[30] Foreign Application Priority Data

Jan. 13, 1981 [DE] Fed. Rep. of Germany ..... 3100789

[51] Int. Cl.[3] ..... H01H 71/16

[52] U.S. Cl. ..... 337/66; 200/159 R

[58] Field of Search ..... 337/66; 200/159 R, 159 A

[56] References Cited

FOREIGN PATENT DOCUMENTS 1513570 4/1971 Fed. Rep. of Germany .
2626003 12/1977 Fed. Rep. of Germany .
2634808 2/1978 Fed. Rep. of Germany .
2532734 7/1980 Fed. Rep. of Germany .

*Primary Examiner*—Harold Broome
*Attorney, Agent, or Firm*—Joseph A. Geiger

[57] ABSTRACT

A push button power switch with a thermal overload release and a snap-action contact breaking movement to which is added a snap-action contact making movement provided by a flexible leg portion on the switching slide which blocks the contact making movement by abutting against a nose of the switch housing while cocking a compression spring, until the push button, just prior to reaching its depression stop, triggers the contact making movement by deflecting the abutment tongue of the flexible leg portion away from the abutment nose of the housing. A cam slide with an inclined oblong cam wall and an integral flexible limb operates the snap-action contact breaking movement by controlling a spring-loaded latch slide.

6 Claims, 5 Drawing Figures

PUSH BUTTON POWER SWITCH

BACKGROUND OF THE INVENTION

1. Field of the Invention

The present invention relates to electrical switches of the push-button-operated type and, more particularly, to a push button power switch with a thermal overload release and snap-action movements in the breaking and making of contact.

2. Description of the Prior Art

From the prior art are known push button power switches which have a thermal overload release, actuated by an overload current which heats up a bimetallic member to displace a latch, thereby breaking the contacts even if the push button remains depressed. Switches of this type are disclosed in the German Pat. Nos. 15 13 570 and 25 32 734 and in the German Offenlegungsschriften (Published Applications) Nos. 26 26 003 and 26 34 808.

Also known from the prior art are push button power switches which produce a snap-action release movement, independently of the push button return movement, in order to minimize arcing across the contacts, as they separate. An advantageous combination of the snap-action release feature with the thermal overload release feature is suggested in the German Pat. No. 25 32 734.

The disclosed switch has a push button with a hollow stem which is guided in a switch housing for straight-line movements. Inside the hollow push button stem is longitudinally guided a push button plunger which is biased upwardly into the stem by a comparatively weak return spring supported by the housing and has a comparatively strong compression spring arranged between its upper end and the push button. The push button plunger carries a transversely extending switching yoke which is connected to the plunger by means of a yoke pin, so that the switching yoke is pivotable in the manner of a balance beam, while moving up and down with the push button plunger.

One extremity of the switching yoke cooperates with a nose of a latch slide which is guided in the housing for transverse movements, the nose thus forming a fulcrum for the switching yoke. The other extremity of the switching yoke bears against a vertically movable switching slide, the movements of which are transmitted to two or more horizontally cantilevered contact blades, to make and brake contact with cooperating stationary contacts.

A downward movement of the push button is thus followed by a downward movement of the push button plunger and its connected switching yoke, following a partial compression of the stronger compression spring. With the nose of the latch slide acting as a fulcrum for the latching extremity of the switching yoke, its switching extremity drives the switching slide downwardly, in opposition to a return spring, to move the switching blades into abutment with the stationary contacts.

Cooperating with the latch slide is a bimetallic member, heated by an in-series electrical resistance. The bimetallic member is so arranged that an excessive current, indicative of an overload condition, heats and deflects the member to such an extent that the nose of the latch slide is withdrawn from underneath the latching extremity of the switching yoke, allowing the latter to tilt and the switching slide to be lifted by its return spring, even with the push button fully depressed. Accordingly, the push button movement cannot be transmitted to the switching slide, for as long as the bimetallic member remains in its overload condition, with the latch slide withdrawn.

The snap-action contact disengagement produced by a withdrawal of the latch slide under overload conditions is also used for the regular contact disengagement, following an upward release of the push button, with the aid of a special cam slide which is guided for transverse movement in the same direction as the latch slide. A drive pin extending from the push button stem cooperates with the cam slide in such a way that a release movement of the push button produces a movement of the cam slide against the latch slide. As the latch slide is pushed back from under the latching extremity of the switching yoke, in opposition to a latch positioning spring, it produces the same snap-action contact disengagement as when the switch is released through thermal overload.

As the push button moves to its fully released position, its drive pin returns the cam slide to a retracted position, thereby allowing the latch slide to return to its latching position. As suggested in the aforementioned German Pat. No. 25 32 734, the cam slide may be so arranged that it produces a detent action in the depressed position of the push button. This detent action requires a second actuation of the push button, in order to shift the cam slide to a position in which the release movement of the push button is possible.

A shortcoming common to these prior art switches is that their contact making movements are not independent in speed from the push button movements, so that it is possible, for example, for the contact blades to establish only partial contact or to rebound, causing arcing in the process and potential damage to the device controlled by the switch.

SUMMARY OF THE INVENTION

Underlying the present invention is the objective of improving the described prior art push button power switch in such a way that a snap-action is provided in connection with the contact making movement of the contact blades of the switch, in addition to and independently of their known snap-action contact breaking movement. Accordingly, the contacts are to be closed at a speed which is determined by a spring, independently of the speed at which the push button is depressed.

The present invention proposes to attain this objective by suggesting an improved push button power switch of the described kind which includes, as part of its vertically movable switching slide, a transversely movable abutment member which cooperates with an abutment nose of the switch housing to block the downward movement of the switching slide, while the compression spring above the push button plunger is cocked. The abutment member is biased towards a normal, abutting position and the push button stem, together with the abutment member, form a trigger means for the initiation of an abutment member release action, when the push button executes a terminal portion of its downward movement. The escape of the abutment member from the abutment nose of the housing frees the switching slide—and, consequently, also the switching yoke and the push button plunger—to execute a snap-action downward movement, under the influence of the cocked compression spring.

In a preferred embodiment of the invention, the abutment member is a vertically oriented flexible leg portion of the switching slide which is integrally attached to the latter by its upper extremity and extends downwardly in a cantilever fashion in the immediate vicinity of the push button stem. This flexible leg portion is resiliently deflectable in a direction away from the push button stem and out of reach of the abutment nose of the housing, springing back to a normal position in which it performs the slide-blocking function.

The flexible leg portion of the switching slide has preferably an enlarged lower extremity forming an abutment tongue. The latter defines trigger means in cooperation with a trigger edge at the lower extremity of the push button stem. For this purpose, the abutment tongue forms an inclined trigger cam which is located in the path of the trigger edge, near the lowest point of that path. The push button stem thus deflects with its trigger edge the abutment tongue of the switching slide leg portion out of engagement with the abutment nose, thereby triggering the snap-action contact-making movement of the switching slide.

The abutment nose of the switch housing is preferably provided with a chamfer on its underside, so that the abutment tongue of the switching slide leg portion can spring back to its normal position, after it has moved below the abutment nose. The cooperating abutment nose and abutment tongue thus produce a yielding detent action at the beginning of the snap-action upward movement of the switching slide. This configuration also has the advantage of limiting the deflections of the flexible leg portion of the switching slide to momentary deflections, thereby greatly reducing any risk of failure of the leg portion due to fatigue.

The advantages of the proposed improvement are evident: The point at which the contact-making movement of the switching slide is triggered is always the same, and the force with which the switching slide is driven by the cocked compression spring is likewise always the same. The result is a consistently high contact-making speed at which wear to the switch and damage to the switched device are minimized.

Lastly, the present invention also suggests an improvement in connection with the cam slide, in the form of a flexible limb on the cam slide which biases the latter in the direction of the latch slide to a normal position in which the cam slide is close to, or touches the latch slide. The cam slide preferably has an inclined cam wall of oblong contour, with oppositely facing upper and lower cam flanks so arranged that the downwardly moving drive pin of the push button cooperates with the upper cam flank to retract the cam slide from its normal position, thereby deflecting its flexible limb, which returns the cam slide, after the drive pin has moved below the cam wall. If follows that, in the release movement of the push button, the drive pin cooperates with the lower cam flank of the cam slide to advance the latter into pushing entrainment with the latch slide, thereby disengaging the latter and triggering the snap-action contact breaking movement of the switching slide.

BRIEF DESCRIPTION OF THE DRAWINGS

Further special features and advantages of the invention will become apparent from the description following below, when taken together with the accompanying drawings which illustrate, by way of example, an embodiment of the invention, represented in the various figures as follows.

DESCRIPTION OF THE PREFERRED EMBODIMENT

Figure 5:
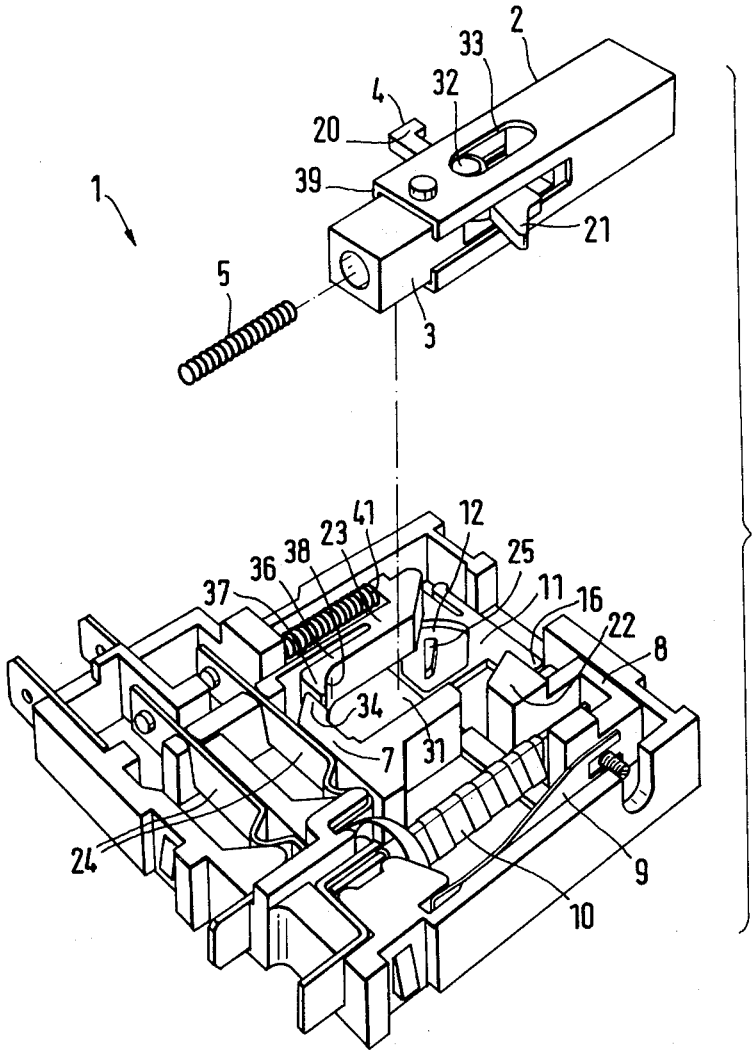
FIG. 5 shows the push button switch of FIGS. 1–4 in a perspective, partially exploded view.

The push button power switch of the invention has a generally rectangular switch housing 1 which, as can best be seen in FIG. 5, has on its inside a number of different ribs and partition walls which form various guide grooves and guide chambers for switch components which execute straight-line movements. In a central guide chamber 31 is received a push button 2 which is movable vertically under pressure applied to the top of the push button. The stem of the push button 2 is rectangular and hollow, serving as a longitudinal guide for a push button plunger 3. The latter, in turn, carries a pivotable switching yoke 4 on a central yoke pin 32. The front and rear walls of the push button stem have appropriate guide slots 33 for the yoke pin 32.

Engaging the push button plunger 3 from below is a return spring 5 which is supported by an abutment wall 7 of the switch housing 1. Inside the hollow push button, between the transverse top wall of the push button 2 and the upper extremity of plunger 3 is arranged a cock spring 6. Both springs are simple compression springs, but the cock spring 6 is much stronger than the return spring 5, with the result that the push button plunger is always biased downwardly, against the abutment wall 7 of housing 1.

In another guide chamber inside the switch housing 1 is arranged a latch slide 8 which is guided for horizontal movements towards and away from the push button 2. A flat latch positioning spring 9 applies to the latch slide 8 a bias in the direction of the push button 2, thereby holding it in its normal engaged position. The latch slide 8 is engaged by an overload release member, as for example, the free extremity of a cantilever-type bimetallic member 10 which, in response to being heated by a coil receiving an overload current, shifts the switch slide 8 away from the push button 2. The operation of such as overload release arrangement is known and is described, for example, in the German Patent No. 25 32 734.

Facing the latch slide 8 is a cam slide 11 which is similiary received and guided in the switch housing 1 for horizontal movements. However, while the cam slide 8 thus moves perpendicularly to the push button 2, like the latch slide 8, it is located behind the push button 2, cooperating with a drive pin 19 on the side of the latter.

The drive pin 19 of the push button 2 engages a cam track 12 of the cam slide 11. The cam track 12 circumscribes an oblong cam wall 25 with substantially parallel inclined upper and lower cam flanks defining a contact making track portion 13, a reversing track portion 14 and a contact breaking track portion 15. The cam slide 11 has a nose 16 which extends beyond the push button 2 into engagement, or near-engagement, with the latch slide 8, when both slides are in their normal positions.

The cam slide 11 also has a built-in spring in the form of a flexible limb 17 which provides a limited rebound action for the cam slide 11, when the latter reaches its extreme retracted position, against the wall 18 of the housing 1, as the drive pin 19 of the push button 2 cooperates with the reversing track portion 14 of the cam slide 11. The flexible limb 17 has its upper end integrally attached to the cam slide 11.

The switching yoke 4 of the push button assembly cooperates with the latter in the manner of a balance beam. Thus, the yoke 4 has on one side a latching extremity 21 which cooperates with a latch nose 22 of the latch slide 8, engaging the latter from above. The opposite end of the switching yoke 4 forms a switching extremity 20 in engagement with a vertically movable switching slide 23. The latter is guided for movements alongside the push button 2, reaching downwardly into a switching chamber of the housing 1, where the switch has two cantilever-type contact blades 24 whose movable distal end portions are received in transverse grooves of the switching slide 23. The vertical movements of the switching slide 23 are thus transmitted to the contact blades 24, to make or break contact with a pair of stationary contacts 40.

The switch housing 1 has a transverse abutment wall 7 at the bottom end of its push button guide chamber 31, the abutment wall 7 serving as a support for the push button return spring 5 and as a movement stop for both the push button 2 and the push button plunger 3. The abutment wall 7 faces the switching slide 23 with an abutment nose 34 the underside of which forms a receding nose chamfer 35. A slide return spring 41 arranged between a housing wall and a shoulder near the upper end of the switching slide 23 imparts a contact breaking upward bias to the switching slide.

The switching slide 23 has a flexible leg 36 in longitudinal sliding contact with a side wall of the push button 2. The upper end of the flexible leg 36 is integrally attached to the switching slide 23 so that its lower end is deflectable transversely in the manner of a cantilever spring. An abutment tongue 37, formed at the lower end of the flexible leg 36, protrudes in the direction of the abutment nose 36 of the housing, so as to cooperate with the latter to stop the downward contact-making movement of the switching slide 23. An inclined trigger cam 38 of the abutment tongue is engageable by a trigger edge 39 at the bottom corner of the push button 2.

Figure 1:
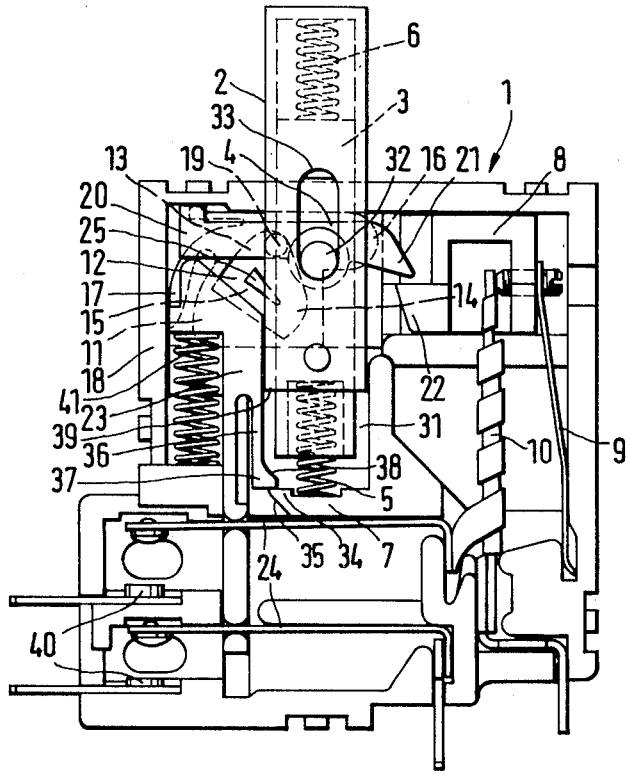
FIG. 1 shows the push button power switch of the invention in an elevational view, with the front half of the housing removed, the switch being shown in its disconnected rest position.

In FIG. 1, the push button power switch of the invention is shown in its rest position in which the contact blades 24 are raised from the stationary contacts 40. The latching extremity of the switching yoke 4 is positioned freely above the latch nose 22 of the latch slide 8.

Figure 2:
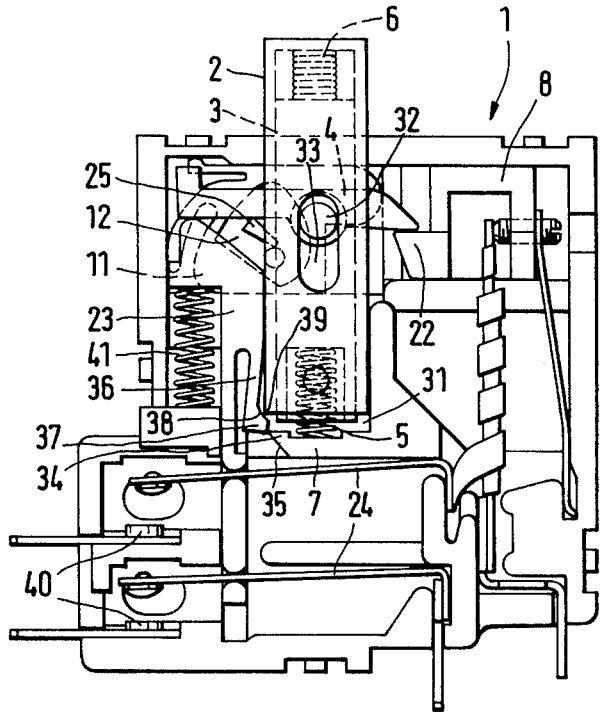
FIG. 2 shows the switch of FIG. 1 in a position just prior to the triggering by the push button of a snap-action contact making operation.

In order to produce a contact-making action, the push button 2 is depressed until it reaches the position shown in FIG. 2. In the course of this downward movement of the push button 2, its drive pin 19 engages the upper cam flank of the inclined cam wall 25, as it moves through the contact-making portion 13 of the cam track 12, thereby retracting the cam slide 11 to the left, toward the housing wall 18. The consequent deflection of the flexible limb 17 of the cam slide 11 is greatest, when the drive pin 19 glides past the lower right-hand extremity of the inclined cam wall 25, in the reversing track portion 14.

As the push button 2 moves downwardly, it tends to take along the push button plunger 3, because of the much higher spring constant of the cock spring 6, as compared to the return spring 5. However, after a minimal initial plunger movement, its further downward advance is blocked, as the latching extremity 21 of its switching yoke 4 is stopped by the latch 22 of the latch slide 8 and the switching extremity 20 of the yoke 4 is stopped by the switching slide 23 which, in turn, is stopped by the abutment nose 34 of the housing 1.

It follows that the downward advance of the push button 2 produces a progressive compression of the cock spring 5 which continues, until the trigger edge 39 of the push button 2 comes to engage the inclined trigger cam 38 of the abutment tongue 37, only a short distance before the push button 2 reaches the bottom end of its stroke, at the abutment wall 7. In this terminal portion of the push button movement, the flexible leg 36 is resiliently deflected, as shown in FIG. 2, so that the abutment tongue 37 can slide past the abutment nose 34.

Figure 3:
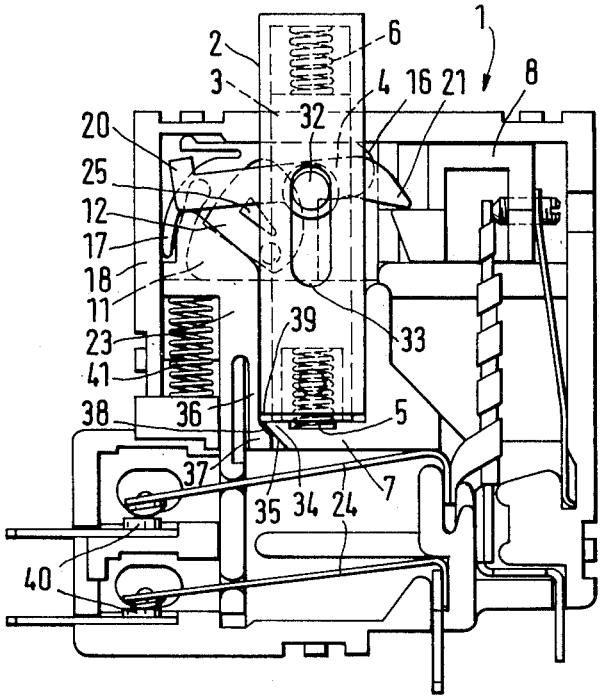
FIG. 3 shows the switch of FIG. 2, after the execution of the contact making movement.

The result of the release of the abutment tongue 37 is a snap-action downward movement of the switching slide 23, under the stored energy of the cock spring 6. The latch nose 22 serves as a fulcrum support for the latching extremity 21 of the switching yoke 4, as its switching extremity 20 is driven downwardly by the plunger movement. The contact-making movement of the contact blades 24 is therefore a consistently rapid movement, generated by the cock spring 5 independently of the manner in which the push button 2 is depressed. FIG. 3 shows the closed position of the switch.

In order to produce a contact-breaking action, the push button 2 is released for an upward movement, under the action of the push button return spring 6. The cock spring 5, meanwhile, maintains a downward pressure on the push button plunger 3 which is greater than the upward bias of the switching slide return spring 41. During a first portion of this upward movement, the drive pin 19 of the push button engages the lower cam flank of the inclined cam wall 25, thereby pushing the cam slide 11 to the right. The nose 16 of the cam slide 11, in engagement with the latch slide 8, imparts this movement to the latter, thereby disengaging the latch nose 22 from under the latching extremity 21 of the switching yoke 4.

Figure 4:
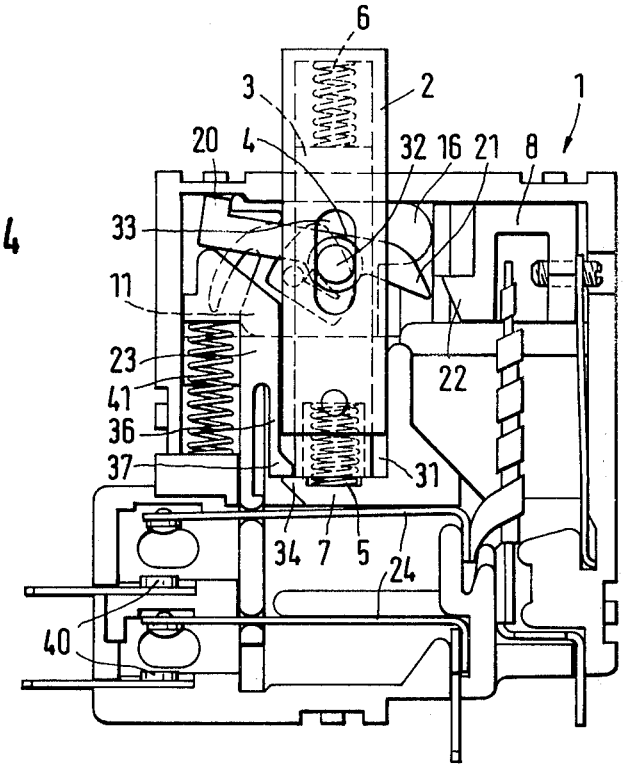
FIG. 4 shows the same switch, following a partial release movement of the push button and the triggering of a snap-action contact breaking operation.

The switching yoke 4, having lost its fulcrum support on the latch slide 8, executes a clockwise pivoting motion to allow for a snap-action contact-breaking upward movement of the switching slide 23, under the influence of its return spring 41. The resulting open position of the switch, with the push button 2 still partially depressed, is shown in FIG. 4. As can be seen from this position, an immediate downward reversal of the push button movement will not produce a contact-making action, because the latching extremity 21 of the yoke 4 is still out of its fulcrum position.

Similarly, it is impossible to produce a contact-making action, if the latch slide 8 has been retracted by the bimetallic member 10, due to an overload condition. Only after the push button 2 has been allowed to return to its upper stop position, and after the latch nose 22 has returned to its normal position under the latching extremity 21, is it possible to reclose the switch by depressing the push button 2.

FIG. 3 shows that, in the closed position of the switch, the flexible leg 36 of the switching slide 23 is no longer deflected, thanks to the nose chamfer 35 on the underside of the abutment nose 34 which provides space for the protruding abutment tongue 37. This means that the deflection of the flexible leg 36 is never maintained for any appreciable length of time, but lasts only a split second during the snap-action contact-making and contact-breaking movements of the switching slide 23. This configuration offers a considerable reduction in bending fatigue and a correspondingly increased longevity of the switching slide.

The push button power switch as described above is of the type which does not provide a detent action in the fully depressed position of the push button. However, it is possible to provide such a detent action by means of an appropriately modified cam track on the cam slide. An example of such a modification is disclosed in the German Pat. No. 25 32 734.

It should be understood, of course, that the foregoing disclosure describes only a preferred embodiment of the invention and that it is intended to cover all changes and modifications of this example of the invention which fall within the scope of the appended claims.

We claim the following:

1. A push button power switch with snap-action contact braking and contact making movements comprising a switch housing, a push button with a hollow stem guided by the housing for vertical downward movements under a push-button-depressing force, a push button plunger guided for vertical movements within the stem, a comparatively weak compression spring serving as a push button return spring by biasing the push button plunger upwardly into the push button in relation to the housing, a comparatively strong compression spring serving as a cock spring between the push button and the upper extremity of the push button plunger, a generally horizontally oriented switching yoke carried by the push button plunger and extending from one side of the push button with a switching extremity and from the other side with a latching extremity, the switching yoke being pivotably connected to the push button plunger in the manner of a balance beam, a latch slide guided by the housing for horizontal movements into and out of engagement under the latching extremity of the switching yoke, including means for biasing the latch slide toward its engaged position, and a switching slide guided by the housing for vertical movements alongside the push button, the switching slide thereby controlling the contact making and contact breaking positions of at least one contact blade in relation to at least one associated stationary contact, the switching extremity of the switching yoke cooperating with the switching slide by pushing it downwardly, in opposition to a slide return spring weaker than the cock spring, when the push button is depressed, while the latching extremity of the switching yoke is engaged by the latch slide to serve as a yoke fulcrum; the switch further comprising a cam slide guided by the housing for horizontal movements into and out of pushing entrainment of the latch slide in the direction of disengagement, and caming means defined by the cam slide and the push button for the creation of a latch-slide-disengaging cam slide movement in a first portion of an upward release movement of the push button from its fully depressed position, with the effect that the switching yoke is freed to pivot, thereby allowing a snap-action upward movement to be imparted to the switching slide by its return spring, the improvement in said switch comprising:

an abutment member which is movable transversely to the movement direction of the switching slide and which, in its normal position, cooperates with the switching slide and with the switch housing to block the downward movement of the switching slide in relation to the housing, thereby producing a compression of the cock spring, when the push button is depressed;

means for resiliently biasing the abutment member in the sense of a return to its normal blocking position; and trigger means defined by the abutment member and the push button for the creation of an abutment member release movement, away from its normal position, in response to the push button reaching the vicinity of its fully depressed position, with the effect that the switching slide is freed to execute a snap-action downward movement imparted to it by the cock spring, via the push button plunger and the switching yoke.

2. A push button switch as defined in claim 1, further comprising a bimetallic member and a cooperating series-connected heating element which, under an overload current, heats and deflects the bimetallic member, the bimetallic member being a substantially vertically cantilevered member whose lower extremity is attached to the housing and whose upper extremity cooperates with the latch slide to retract and disengage the latter from under the latching extremity of the switching yoke, when the bimetallic member is deflected by an overload current.

3. A push button switch as defined in claim 1 or claim 2, wherein the abutment member has the form of a vertically oriented flexible leg portion of the switching slide, being attached thereto by its upper extremity and extending downwardly in the immediate vicinity of the push button stem, the flexible leg portion forming at its lower extremity an abutment tongue which, in its normal position, extends into the path of the push button stem and, by virtue of the flexibility of the leg portion, is deflectable away from its normal position by the downward advance of said stem;

the abutment member biasing means is provided by the inherent bending resiliency of the flexible leg portion itself;

the housing includes a fixed abutment nose which cooperates with the abutment tongue of the flexible leg portion of the switching slide to produce said slide-blocking action in the normal position of said abutment tongue; and the trigger means includes a trigger edge on the lower extremity of the push button stem and an inclined trigger cam on the abutment tongue of the flexible leg portion located in the path of the trigger edge, near the lowest point of said path, in the normal blocking position of the abutment tongue, so that, during a terminal portion of the downward movement of the push button, its trigger edge deflects the abutment tongue out of engagement with the abutment nose, thereby initiating said snap-action movement of the slide.

4. A push button switch as defined in claim 3, wherein the abutment nose of the housing has on its underside a chamfer which allows the abutment tongue to spring back to its normal position, following its movement past the abutment nose, and which co-operates with the trigger cam of the abutment tongue during the snap-action upward movement of the switching slide in the manner of a yielding detent.

5. A push button switch as defined in claim 1 or claim 2, wherein the cam slide includes means for biasing the cam slide towards the latch slide, into a normal cam slide position in which it has a minimal distance from the latch slide when the latter is in its normal position;

the push button includes, as part of the caming means, a drive pin which extends laterally from the push button stem into engagement with the cam slide; and the cam slide further includes, as part of the caming means, an inclined cam wall of generally oblong contour, presenting oppositely facing upper and lower inclined cam flanks to the drive pin, the cam flanks and the drive pin being so arranged that, during a downward movement of the push button, its drive pin cooperates with the upper inclined cam flank to retract the cam slide a distance from its normal position, in opposition to the cam slide biasing means, and that, in the lowest position of the drive pin, the cam slide is free to return to its normal position, the retraction distance being such that, during a subsequent upward movement of the push button, its drive pin cooperates with the lower inclined cam flank to advance the cam slide against the latch slide, thereby disengaging the latch slide and initiating said snap-action upward movement of the switching slide.

6. A push button switch as defined in claim 5, wherein the cam slide biasing means is constituted, at least in part, by a flexible limb of the cam slide which is capable of resilient deflection in the direction of cam slide displacement.

* * * * *